US008476777B2

(12) United States Patent
Usami et al.

(10) Patent No.: US 8,476,777 B2
(45) Date of Patent: Jul. 2, 2013

(54) STARTER MOUNTED ON VEHICLE HAVING IDLE-STOP APPARATUS

(75) Inventors: Shinji Usami, Okazaki (JP); Mitsuhiro Murata, Niwa-gun (JP); Masami Niimi, Handa (JP)

(73) Assignee: Denso Corporation, Kariya (JP)

( * ) Notice: Subject to any disclaimer, the term of this patent is extended or adjusted under 35 U.S.C. 154(b) by 469 days.

(21) Appl. No.: 12/732,733

(22) Filed: Mar. 26, 2010

(65) Prior Publication Data

US 2010/0251853 A1 Oct. 7, 2010

(30) Foreign Application Priority Data

Apr. 2, 2009 (JP) ..... 2009-090253

(51) Int. Cl.
*F02N 11/00* (2006.01)

(52) U.S. Cl.
USPC ..... 290/38 R; 123/179.3

(58) Field of Classification Search
USPC ..... 290/38 R; 74/7 C; 123/179.1–179.4
See application file for complete search history.

(56) References Cited

U.S. PATENT DOCUMENTS

| | | | | |
|---|---|---|---|---|
| 6,615,786 | B2 * | 9/2003 | Mori et al. | 123/179.31 |
| 6,651,603 | B2 * | 11/2003 | Osada et al. | 123/179.3 |
| 7,275,509 | B2 | 10/2007 | Kassner | |
| 7,665,438 | B2 * | 2/2010 | Hirning et al. | 123/179.3 |
| 7,996,135 | B2 * | 8/2011 | Ishii et al. | 701/54 |
| 8,171,908 | B2 * | 5/2012 | Senda et al. | 123/179.4 |
| 8,193,882 | B2 * | 6/2012 | Murata et al. | 335/126 |
| 2008/0162007 | A1 | 7/2008 | Ishii et al. | |

FOREIGN PATENT DOCUMENTS

| | | |
|---|---|---|
| JP | A-11-030173 | 2/1999 |
| JP | A-2003-003938 | 1/2003 |
| JP | A-2003-083212 | 3/2003 |
| JP | A-2007-107527 | 4/2007 |
| JP | A-2008-510099 | 4/2008 |
| JP | A-2008-163818 | 7/2008 |
| JP | A-2009-191843 | 8/2009 |

OTHER PUBLICATIONS

Dec. 21, 2012 Office Action issued in Japanese Patent Application No. 2009-090253 (with Translation).
Mar. 19, 2013 Office Action issued in Japanese Patent Application No. 2009-090253 w/translation.

* cited by examiner

*Primary Examiner* — Michael Zarroli
(74) *Attorney, Agent, or Firm* — Oliff & Berridge, PLC

(57) ABSTRACT

A starter includes an electromagnetic solenoid that generates force for pushing a pinion gear 6 to a ring gear side, and an electromagnetic switch that opens and closes a motor contact point. When idle-stop is performed, an ECU energizes a solenoid coil of the electromagnetic solenoid during inertial rotation until the ring gear stops rotating. After rotation of an engine is stopped, the ECU stops energizing the solenoid coil. As a result, in the starter, the pinion gear can mesh with the ring gear that is rotating by inertia without use of the rotational force of a motor. The meshed state can be maintained even after energization of the solenoid coil is stopped.

14 Claims, 6 Drawing Sheets

STARTER MOUNTED ON VEHICLE HAVING IDLE-STOP APPARATUS

CROSS-REFERENCE TO RELATED APPLICATION

This application is related to Japanese Patent Application NO. 2009-90253 filed on Apr. 2, 2009, the contents of which are hereby incorporated by reference.

BACKGROUND OF THE INVENTION

1. Field of the Invention

The present invention relates to a starter for starting an engine mounted on vehicles such as passenger cars, and more particularly to a pinion shift-type starter for vehicles having idle-stop apparatus.

2. Description of the Related Art

An increase in vehicles including an idle-stop apparatus that automatically controls stop and restart of an engine (referred to, hereinafter, as idle-stop vehicles) is expected in the next few years to reduce carbon dioxide emission and improve fuel efficiency.

An idle-stop vehicle frequently encounters situations on the road in which the engine is automatically stopped, such as stopping at a traffic light at an intersection, and temporarily stopping during a traffic jam and the like. Therefore, the engine is required to be restarted as quickly as possible and with reliably when a driver performs an operation to move the vehicle (such as a release operation of the brake pedal, or a shift operation to a drive range) after the engine is stopped.

Japanese Patent Laid-open Publication No. 2008-163818 discloses a starter. In the starter, after an engine is completely stopped, a coil of an electromagnetic switch is energized, and a pinion gear is meshed with a ring gear of the engine. The state in which the pinion gear is meshed with the ring gear is subsequently maintained even when energization of the coil is stopped, as a result of movement resistance generated when the clutch moves integrally with the pinion gear along an output shaft. In the starter, the meshed state between the pinion gear and the ring gear can be maintained in while the engine is stopped. Therefore, the engine can be restarted in a short amount of time in response to an engine restart request.

However, in the document No. 2008-163818, because the pinion gear is meshed with the ring gear after the engine has completely stopped, the engine cannot be restarted immediately after it is stopped. In other words, the coil of the electromagnetic switch is energized and the pinion gear is meshed with the ring gear after a judgment is made that the engine has completely stopped. Therefore, time is required until the pinion gear actually meshes with the ring gear after the engine is completely stopped. In other words, the pinion gear has not yet meshed with the ring gear at the time the judgment is made that the engine has completely stopped. Therefore, the engine can not necessarily restart quickly.

Moreover, the patent document described above, states that the pinion gear can be meshed with the ring gear during inertial rotation that occurs until the engine comes to a complete stop. In this instance, because the ring gear is rotating at a low speed, the pinion gear can be meshed with the ring gear merely by being pushed toward the ring gear side, without a motor being rotated. Considering the idle-stop vehicles, starters are frequently used to perform idle-stop compared to starters that do not perform the idle-stop. Therefore, wearing of a motor contact point may progress due to frequent use of the motor.

However, in the starter described in the patent document described above, a single electromagnetic switch serves to push the pinion gear toward the ring gear side via a shift lever, and to open and close the motor contact point. In this configuration, the motor contact point closes and a rotational force is generated in the motor almost simultaneously with an end surface of the pinion gear coming into contact with an end surface of the ring gear. Therefore, it is not possible to push only the pinion gear towards the ring gear and mesh the pinion gear with the ring gear, without rotating the motor.

SUMMARY OF THE INVENTION

The present invention has been made based on the above-described issues. An object of the present invention is to provide a starter that can mesh a pinion gear with a ring gear during inertial rotation of the ring gear without using rotational force of a motor, and maintain the meshed state between the pinion gear and the ring gear after an engine stops.

A first aspect of an invention of the present application is a starter mounted on a vehicle having an idle-stop apparatus that automatically controls stop and restart of an engine. The starter includes: a motor that generates rotational force by being energized; an output shaft that rotates by receiving the rotational force from the motor; a one-way clutch that is engaged with an outer circumference of the output shaft by a helical spline; a pinion gear provided such as to be allowed movement in an axial direction along the outer circumference of the output shaft, integrally with the one-way clutch; an electromagnetic solenoid that generates force for pushing the pinion gear outward in the axial direction (ring gear side of the engine) integrally with the one-way clutch; an electromagnetic switch that opens and closes a motor contact point provided on an energizing circuit of the motor; and a control means for controlling operation of the starter such that the controlling means separately and independently controls operations of the electromagnetic solenoid and operations of the electromagnetic switch. The controlling means energizes the electromagnetic solenoid during inertial rotation until the ring gear stops rotating when the engine is automatically stopped, and stops energizing the electromagnetic solenoid after the engine stops rotating.

The starter of the present invention includes the electromagnetic solenoid that generates force for pushing the pinion gear towards the ring gear side, and the electromagnetic switch that opens and closes the motor contact point. In addition, the starter controls the electromagnetic solenoid and the electromagnetic switch separately and independently. Therefore, the pinion gear can be meshed with the ring gear during the inertial rotation of the ring gear without use of the rotational force of the motor. In other words, while the ring gear is rotating by inertia, the pinion gear can be meshed with the ring gear without the use of the rotational force of the motor, simply by the electromagnetic solenoid being energized and the pinion gear being pushed outward in the axial direction integrally with the one-way clutch. Even when energization of the electromagnetic solenoid is subsequently stopped after the rotation of the engine stops, the pinion gear is not rotated because of the ring gear. Therefore, the meshed state between the pinion gear and the ring gear can be maintained without the pinion gear separating from the ring gear.

In the above-described configuration, the pinion gear and the ring gear are already meshed when the engine stops rotating. Therefore, the engine can be quickly restarted in response to a restart request after the engine is stopped.

A second aspect of the invention of the present application is the starter according to the first aspect, further including a rotation speed detecting means for detecting a rotation speed of the ring gear. The controlling means energizes the electromagnetic solenoid when the rotation speed of the ring gear detected by the rotation speed detecting means drops to a predetermined rotation speed or less, the predetermined rotation speed being lower than an idling engine speed.

In this instance, the electromagnetic solenoid is energized when the rotation speed of the ring gear is within a range lower than the idling engine speed. Therefore, the pinion gear can be meshed with the ring gear with certainty.

A third aspect of the invention of the present application is the starter according to the second aspect, in which the rotation detecting means is a crank angle sensor.

In this instance, the rotation speed of the ring gear can be detected based on sensor information (engine speed) obtained by a pre-existing crank angle senor. Therefore, a special sensor is not required to be provided separately, and the number of components can be reduced.

A fourth aspect of the invention of the present application is the starter according to any one of the first to third aspects, in which the controlling means is an idle-stop electronic control unit involved with control of the idle-stop apparatus. The idle-stop electronic control unit (ECU) involved with control of the idle-stop apparatus is mounted on an idle-stop vehicle. Therefore, the number of components can be reduced by the idle-stop ECU being used as the controlling means.

A fifth aspect of the invention of the present application is the starter according to any one of the first to fourth aspects, in which the starter is configured such that the electromagnetic solenoid and the electromagnetic switch are integrated. The electromagnetic solenoid and the electromagnetic switch are disposed in series in an axial center direction of the electromagnetic solenoid.

In the above-described configuration, dimensions are not increased in two directions radially outward of the motor. Moreover, the total length in the axial direction of the electromagnetic solenoid and the electromagnetic switch does not exceed the overall length of the motor. Therefore, the size of the starter is not increased compared to the conventional starter in which a single electromagnetic switch serves to push the pinion gear outward and to open and close the motor contact point. As a result, the ease of fixing the starter to the vehicle can be ensured in the same way.

A sixth aspect of the invention of the present application is the starter according to any one of the first to fifth aspects, in which the starter is configured such that the electromagnetic solenoid and the electromagnetic switch are separate, individual components. The electromagnetic solenoid and the electromagnetic switch are adjacent to or in contact with each other in an axial center direction of the electromagnetic solenoid.

The frequency of use of the starter significantly increases in an idle-stop vehicle. Therefore, wearing of the motor contact point may progress, requiring replacement. In this regard, because the electromagnetic solenoid and the electromagnetic switch are configured separately and individually in the starter used in the starter of the present invention, only the electromagnetic switch is required to be replaced when the motor contact point wears out and a replacement is required. The running cost can be reduced because the electromagnetic solenoid is not required to be replaced in addition to the electromagnetic switch.

Moreover, many components used in, for example, the electromagnetic switch in the above-described patent document can be used in the electromagnetic solenoid. A general-purpose electromagnetic relay can be used as the electromagnetic switch. Therefore, cost can be reduced.

DETAILED DESCRIPTION OF THE PREFERRED EMBODIMENTS

Preferred embodiments of the present invention will hereinafter be described in detail.

(First Embodiment)

A first embodiment of the present invention will hereinafter be described with reference to FIG. 1 to FIG. 3.

A starter of the present invention is, for example, used in a vehicle (referred to as an idle-stop vehicle) including an idle-stop apparatus. The idle-stop apparatus automatically stops the engine when the vehicle stops at a traffic light at an intersection, or temporarily stops during a traffic jam and the like. Then, the idle-stop apparatus automatically restarts the engine in response to an operation performed by the user to start moving the vehicle. The starter includes a starter 1 (see FIG. 1) that starts the engine, and an idle-stop electronic control unit [ECU] 2 (see FIG. 3) that controls operations of the starter 1.

Figure 1:
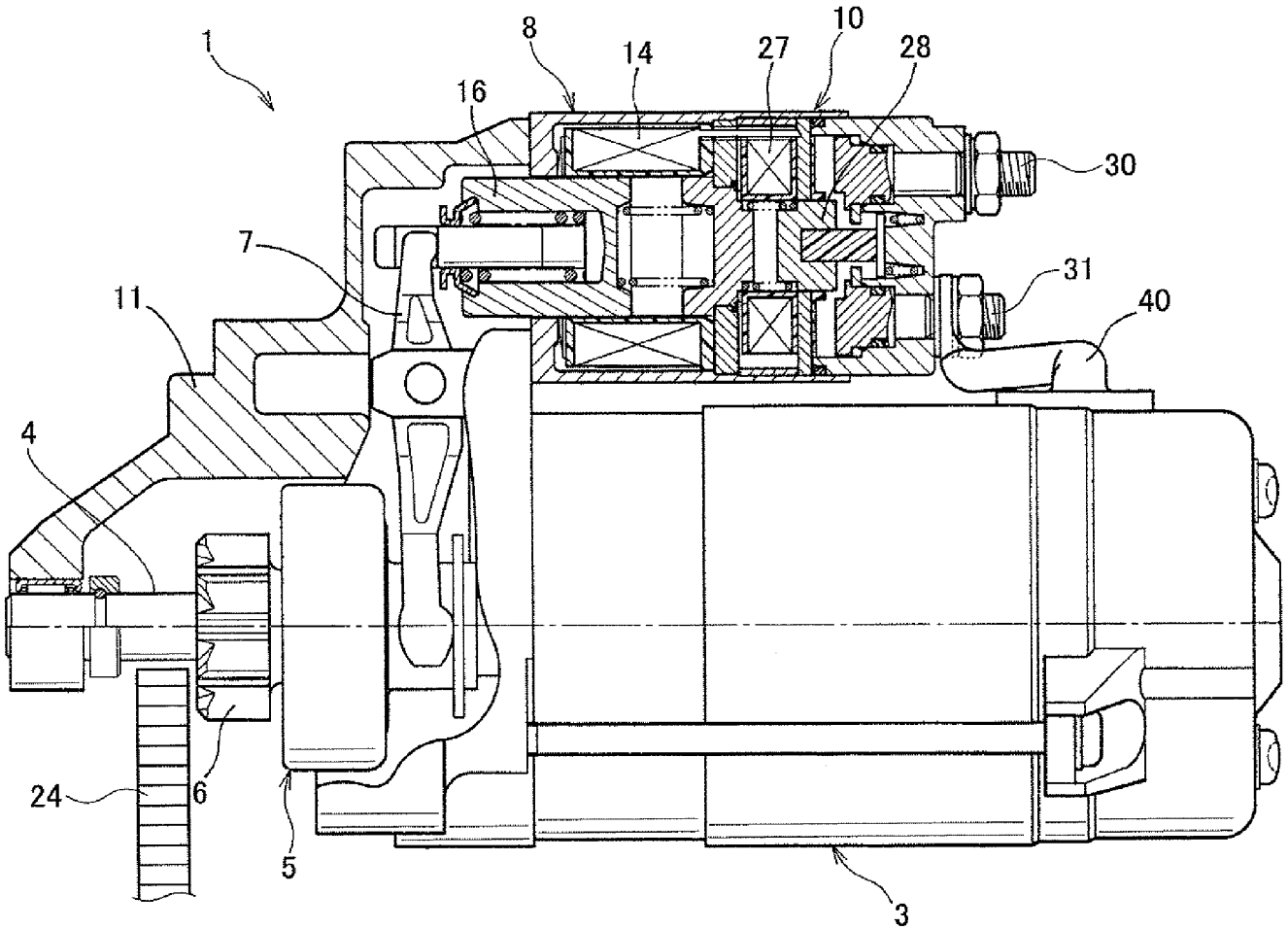
FIG. 1 is a side view of a starter (first embodiment)

As shown in FIG. 1, the starter 1 is configured by a motor 3, an output shaft 4, a one-way clutch 5, a pinion gear 6, an electromagnetic solenoid 8, an electromagnetic switch 10, and the like. The motor 3 generates rotational force in an armature 3*a* (see FIG. 3) included therewithin. The rotational force from the motor 3 is transmitted to the output shaft 4, thereby rotating the output shaft 4. The one-way clutch 5 is engaged to the outer circumference of the output shaft 4 by a helical spline 51. The pinion gear 6 is provided such as to be allowed movement in an axial direction along the outer circumference of the output shaft 4, integrally with the clutch 5. The electromagnetic solenoid 8 generates force for pushing the clutch 5 and the pinion gear 6 in a counter-motor direction (leftward direction in FIG. 1) via a shift lever 7. The electromagnetic switch 10 opens and closes a motor contact point (described hereafter) provided on a motor circuit for sending current from a battery 9 (see FIG. 3) to the motor 3. A reduction gear (such as a planetary reduction gear) that slows the rotation of the motor 3 and transmits the rotation to the output shaft 4 can be provided between the motor 3 and the output shaft 4.

Configurations of the electromagnetic solenoid 8 and the electromagnetic switch 10 will hereinafter be described with reference to FIG. 2 and FIG. 3. Components, devices, and the like of the starter 1 excluding the electromagnetic solenoid 8 and the electromagnetic switch 10 (a starter housing 11, the motor 3, the output shaft 4, the clutch 5, the pinion gear 6, the shift lever 7, a reduction gear, and the like) are configured in a manner similar to those of a conventional starter in which a single electromagnetic switch serves to push outward the pinion gear 6, and to open and close the motor contact point. Therefore, explanations thereof are omitted.

a) Configuration of the Electromagnetic Solenoid 8

The electromagnetic solenoid 8 is disposed radially outward of the motor 3 and fixed to the starter housing 11 in parallel with the motor 3. The electromagnetic solenoid 8 is configured by a solenoid case 12, a solenoid coil 14, a fixed core 15, a plunger 16, a joint 17, and the like. The solenoid coil 14 is wound around a resin bobbin 13 and housed within the solenoid case 12. The fixed core 15 is magnetized by the solenoid coil 14 being energized. The plunger 16 can move in an axial center direction along the inner circumference of the solenoid coil 14. The joint 17 transmits the movement of the plunger 16 to the shift lever 7.

Figure 2:
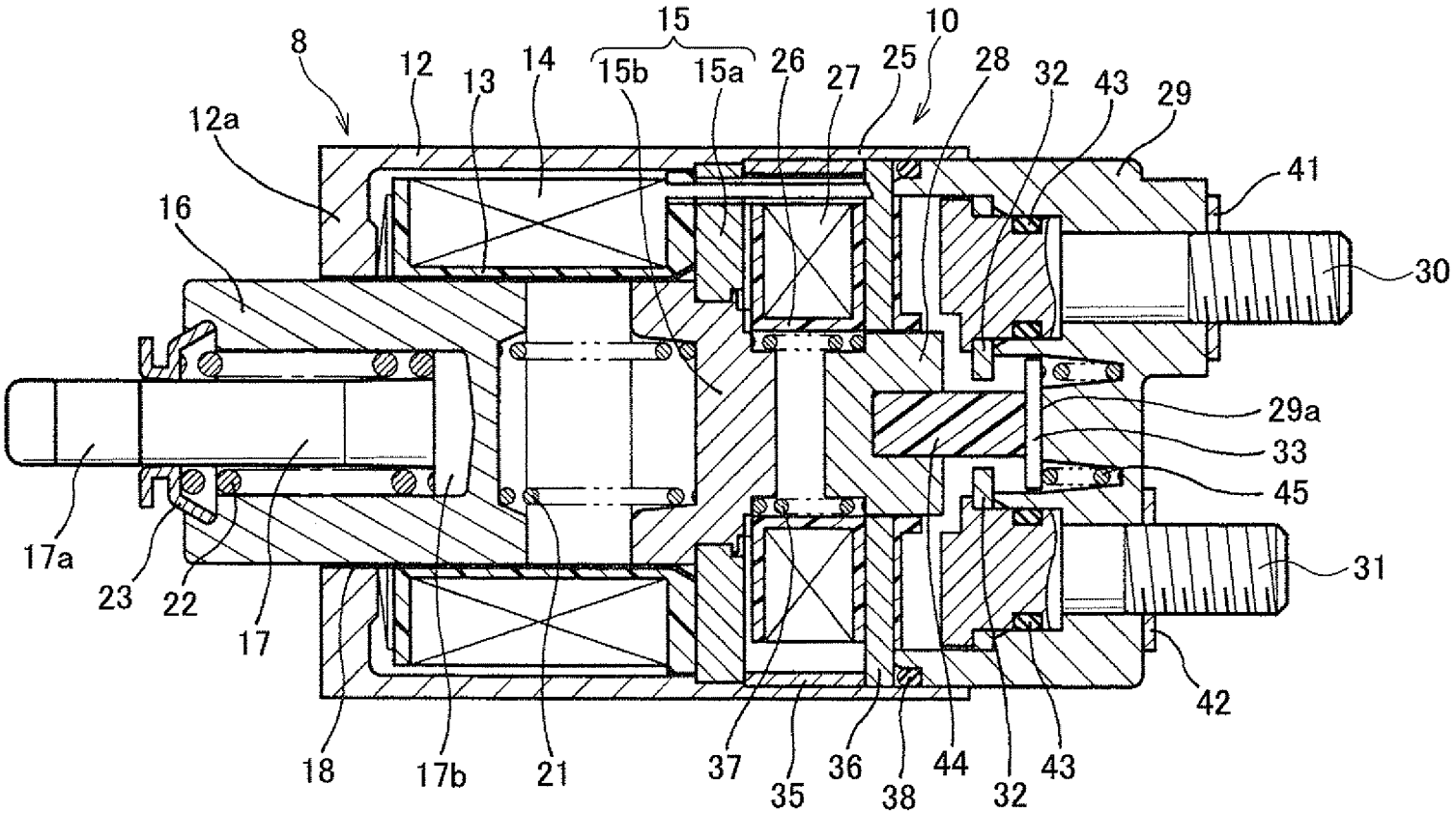
FIG. 2 is a cross-sectional view of an electromagnetic solenoid and an electromagnetic switch (first embodiment)

The solenoid case 12 is provided having a bottomed cylindrical shape with a case bottom section 12*a* on one end side in the axial direction (left side in FIG. 2). A circular hole is formed in the radial-direction center of the case bottom section 12*a*. The circular hole has a same diameter as the inner diameter of the bobbin 13. A cylindrical sleeve 18 for guiding the movement of the plunger 16 is inserted from the inner circumference of the circular hole to the inner circumference of the bobbin 13.

Figure 3:
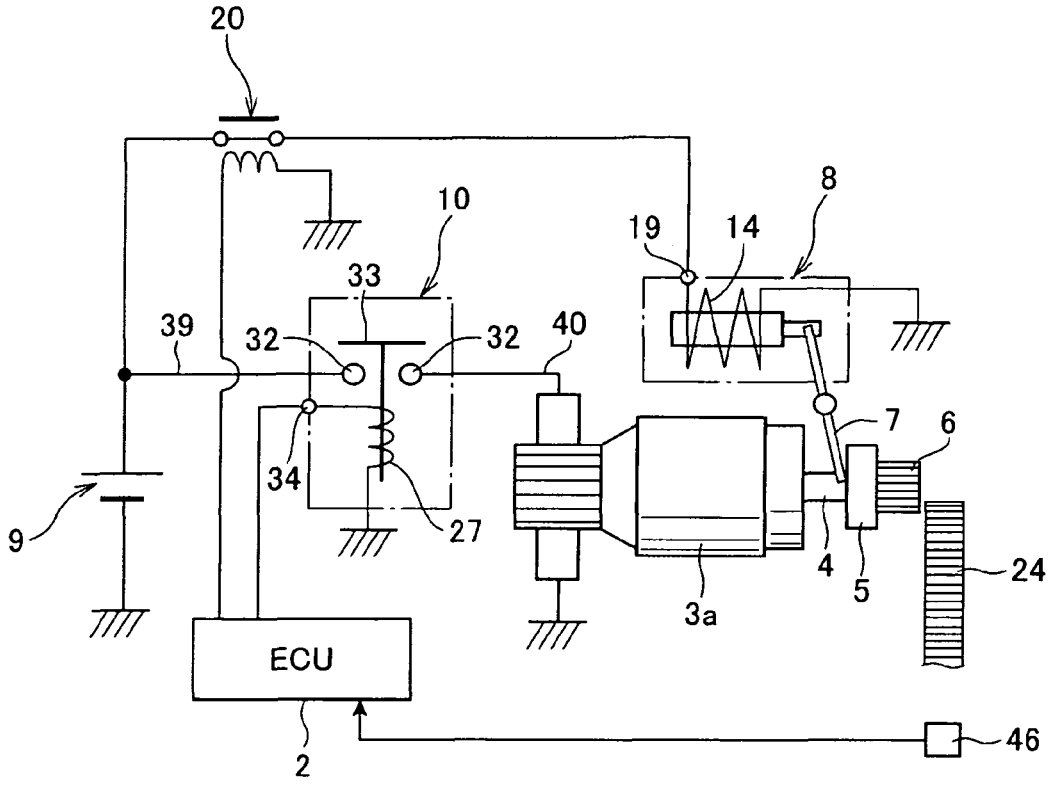
FIG. 3 is an electrical circuit diagram of a starter.
Figure 7:
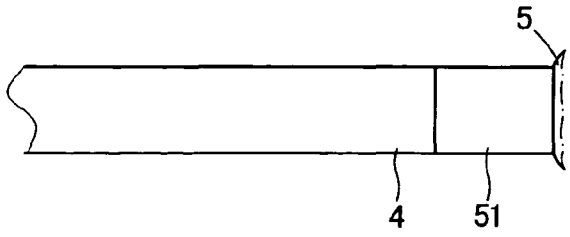
FIG. 7 is a side view of an output shaft with a helical spline.

As shown in FIG. 3, one end section of the solenoid coil 14 is connected to a connecter terminal 19. The other end section is, for example, electrically connected to a surface of the fixed core 15 and grounded. An electrical wire leading to a starter relay 20 is connected to the connector terminal 19.

The ECU 2 controls ON and OFF of the starter relay 20. When an ON control of the starter relay 20 is performed, the battery 9 energizes the solenoid coil 14 via the starter relay 20.

The fixed core 15 is configured divided into a disk-shaped plate section 15*a* and a core section 15*b* fixed to the inner circumference of the plate section 15*a* by crimping. An outer circumferential end section of the plate section 15*a* on the coil side (one end section in the axial direction) in the plate thickness direction is in contact with a stepped section provided on the inner circumference of the solenoid case 12, restricting the position of the plate section 15*a* on the coil side.

The plunger 16 is disposed such as to be allowed movement in the axial direction along the inner circumference of the sleeve 18 (left-right direction in FIG. 2). The plunger 16 is urged in a counter-core section direction (leftward direction in FIG. 2) by a return spring 21 provided between the plunger 16 and the core section 15*b*. The plunger 16 is provided having a roughly cylindrical shape with a cylindrical hole in its radial-direction center. The cylindrical hole is open on one end side of the plunger 16 in the axial direction and has a bottom surface on the other end side in the axial direction.

The joint 17 is inserted into the cylindrical hole of the plunger 16 together with a drive spring 22. The joint 17 is rod-shaped. An engaging groove 17*a* that engages with an end section of the shift lever 7 is provided on one end side of the joint 17 in the axial direction. A flange section 17*b* is provided on the end section on the other end side of the joint 17 in the axial direction. The flange section 17*b* has an outer diameter that allows the flange section 17*b* to slide against the inner circumference of the cylindrical hole. The flange section 17*b* receives load from the drive spring 22 and is pressed against the bottom surface of the cylindrical hole. The drive spring 22 is disposed on the outer circumference of the joint 17. An end section on one end side of the drive spring 22 in the axial direction is supported by a spring receiving section 23 fixed to the opening end section of the plunger 16 by crimping. The end section on the other end side of the drive spring 22 in the axial direction is supported by the flange section 17*b* of the joint 17. After the end surface of the pinion gear 6 pushed outward in the counter-motor direction via the shift lever 7 comes into contact with the end surface of ring gear 24 (see FIG. 3) as a result of the movement of the plunger 16, the drive spring 22 is compressed while the plunger 16 moves until the plunger 16 adheres to the core section 15*b*. The drive spring 22 stores reactive force for meshing the pinion gear 6 with the ring gear 24.

(b) Configuration of the Electromagnetic Switch 10

The electromagnetic switch 10 shares the fixed core 15 with the electromagnetic solenoid 8, and is configured such as to be integrated with the electromagnetic solenoid 8. In addition to the fixed core 15, the electromagnetic switch 10 is configured by a cylindrical switch case 25, a switch coil 27, a movable core 28, a resin contact point cover 29, two terminal bolts 30 and 31, a pair of fixed contact points 32, a movable contact point 33, and the like. The switch case 25 is provided integrally with the solenoid case 12 in a manner in which the opening section side of the solenoid case 12 extends in the axial direction. The switch coil 27 is wound around a resin bobbin 26. The movable core 28 can be moved in an axial center direction of the switch coil 27. The contact point cover 29 is assembled such as to cover an opening section of the switch case 25. The two terminal bolts 30 and 31 are fixed to the contact point cover 29. The pair of fixed contact points 32 are connected to the motor circuit by the two terminal bolts 30 and 31. The movable contact point 33 provides intermittent electrical connected between the pair of fixed contact points 32.

The switch coil 27 is disposed in the inner circumference of the switch case 25 further outward (other end side in the axial direction) than the plate section 15*a* of the fixed core 15. In other words, the solenoid coil 14 is disposed on one end side in the axial direction and the switch coil 27 is disposed on the other end side in the axial direction with the plate section 15*a* therebetween. As shown in FIG. 3, one end section of the switch coil 27 is connected to an external terminal 34. The other end section is, for example, electrically connected to the surface of the fixed core 15 and grounded. The external terminal 34 is provided such as to project further outward than the end surface of the connection point cover 29. An electrical wire leading to the ECU 2 is connected to the external terminal 34. A spacer component 35 and a magnetic plate 36, respectively forming a portion of a magnetic circuit, are disposed on the outer circumference and the counter-plate section side in the axial direction (other end side in the axial direction) of the switch coil 27. The cylindrical spacer component 35 is inserted into the inner circumference of the switch case 25 with almost no gap therebetween. An end surface on the one end side of the spacer component 35 in the axial direction is in contact with the outer circumferential surface of the plate section 15*a*, restricting the position of the spacer component 35 on one end side in the axial direction.

The magnetic plate 36 is insert-molded onto a resin component provided integrally with the bobbin 26. The magnetic plate 36 is disposed perpendicular to an axial center direction of the spacer component 35. An outer circumferential end surface on one end side of the magnetic plate 36 in the axial direction that is exposed from the resin component is in contact with the end surface of the spacer component 35 in the axial direction, restricting the position of the magnetic plate 36 on one end side in the axial direction. A circular hole is formed in the radial-direction center of the magnetic plate 36. The inner diameter of the circular hole is set having roughly the same dimension as the inner diameter of the bobbin 26, such that the movable core 28 can move in the axial direction along the inner circumference of the circular hole. The movable core 28 is disposed such as to be allowed movement in the axial center direction along the inner circumference of the magnetic plate 36 and the inner circumference of the bobbin 26. The movable core 28 is urged in the counter-core section direction (rightward direction in FIG. 2) by a return spring 37 disposed between the movable core 28 and the core section 15*b*.

The contact point cover 29 has a cylindrical leg section. The leg section is inserted into the inner side of the opening section of the switch case 25 and disposed such that the end surface of the leg section is in contact with the surface of the magnetic plate 36. The contact point cover 29 is fixed to the switch case 25 by crimping. The area between the contact point cover 29 and the switch case 25 is sealed by a sealing component 38, such as an o-ring, thereby preventing infiltration of water and the like from outside. The two terminal bolts 30 and 31 are, respectively, a B terminal bolt 30 to which a battery cable 39 is connected (see FIG. 3) and an M terminal bolt 31 to which a motor lead wire 40 is connected (see FIG. 1 and FIG. 3). The two terminal bolts 30 and 31 are respectively fixed to the contact point cover 29 by washers 41 and 42. The areas between the two terminal bolts 30 and 31 and the contact point cover 29 are sealed by sealing components 43, such as an o-ring. The pair of fixed contact points 32 is provided separately from (or integrally with) the two terminal bolts 30 and 31, and is electrically connected to the two terminal bolts 30 and 31 on the inner side of the contact point cover 29.

The movable contact point 33 is disposed further to the counter-movable core side (right side in FIG. 2) than the pair of fixed contact points 32. The movable contact point 33 receives load from a contact point pressure spring 45 and is pressed against an end surface of a resin rod 44 fixed to the movable core 28. However, an initial load of the return spring 37 is set to be greater than an initial load of the contact point pressure spring 45. Therefore, when the switch coil 27 is not energized, the movable contact point 33 sits on an internal seating surface 29*a* of the contact point cover 29 in a state in which the contact point pressure spring 45 is compressed. Motor contact points are formed by the pair of fixed contact points 32 and the movable contact point 33. The motor contact points are in a closed state when force is applied to the movable contact point 33 by the contact point pressure spring 45 and the movable contact point 33 is in contact with the pair of fixed contact points 32 with sufficient pressing force, allowing conduction between the two fixed contact points 32. The motor contact points are in an open state when the movable contact point 33 moves away from the pair of fixed contact points 32, blocking conduction between the two fixed contact points 32.

Next, an operation of the ECU 2 performed when idle-stop is performed will be described. When a stop condition for automatically stopping the engine (such as the vehicle speed being zero and the brake pedal being pressed) is established and idle-stop is performed, the ECU 2 closes the starter relay 20 and energizes the solenoid coil 14 when, during inertial rotation until the ring gear 24 stops rotating, the rotation speed of the ring gear 24 drops to a range that is a predetermined rotation speed (such as 300rpm) or less. The predetermined rotation speed is less than an idling engine speed. After the engine stops rotating, the ECU 2 opens the starter relay 20 and stops energizing the solenoid coil 14. At this time, the switch coil 27 of the electromagnetic switch 10 is not energized.

As shown in FIG. 3, sensor information from a rotation speed detecting sensor 46 that detects the rotation speed of the ring gear 24 is inputted into the ECU 2. However, rather than a dedicated rotation speed detecting sensor 46 being provided, sensor information can be inputted from a pre-existing crank angle sensor. The rotation speed of the ring gear 24 can be detected based on the inputted sensor information. After the engine is stopped, when a restart condition for restarting the engine (such as the user performing a release operation of the brake pedal, or a shift operation to a drive range) is established, the ECU 2 closes the starter relay 20 and energizes the solenoid coil 14. At the same time, the ECU 2 energizes the switch coil 27 and starts the starter 1.

When the engine is started, the ECU 2 opens the starter relay 20 and stops energizing the solenoid coil 14. In addition, the ECU 2 stops energizing the switch coil 27.

Figure 6:
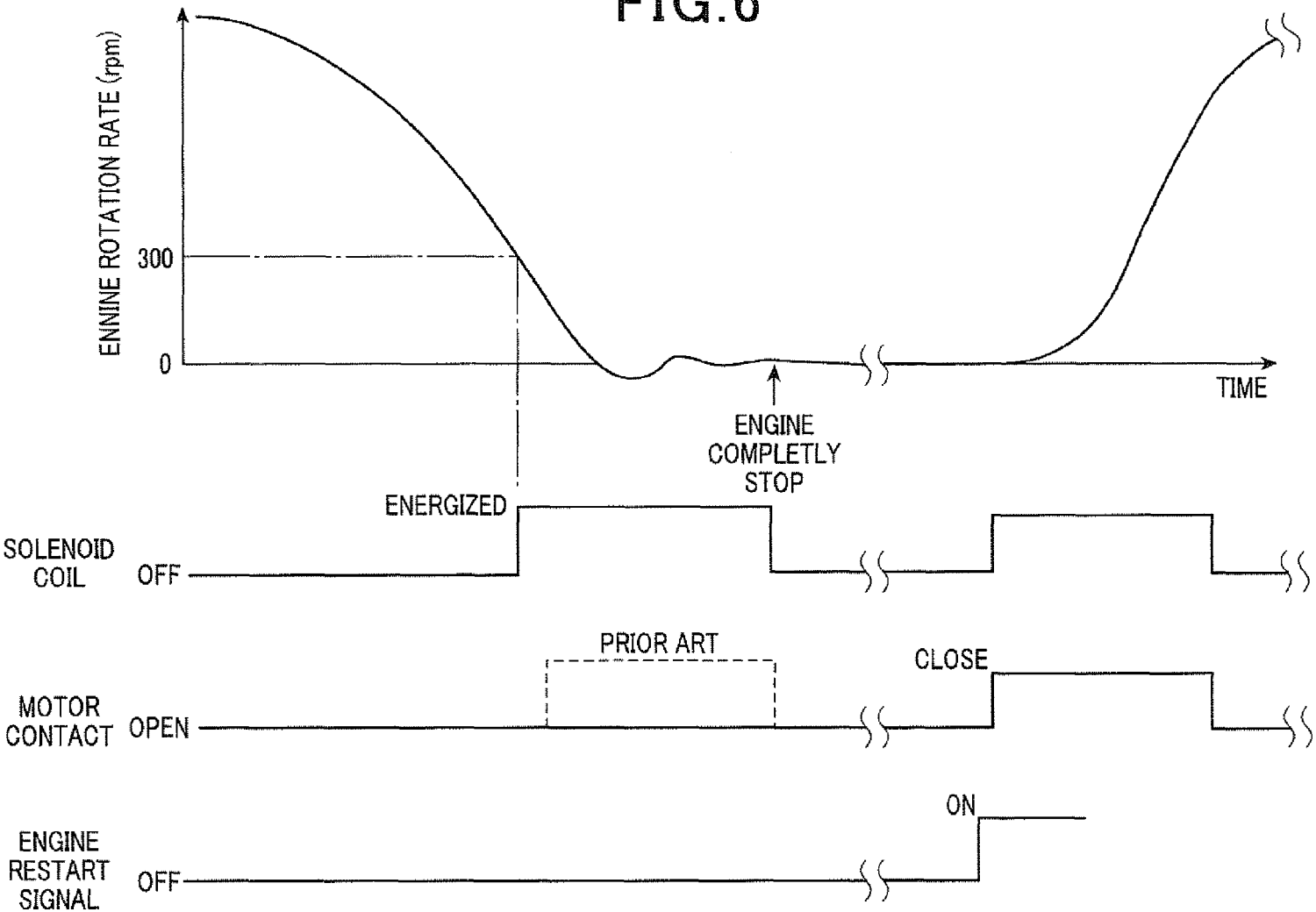
FIG. 6 is a timing diagram illustrating an operation of starter.

Next, with reference to FIG. 6, operations of the starter 1 will be described. When idle-stop is performed, and the starter relay 20 is closed and the solenoid coil 14 is energized during the inertial rotation of the ring gear 24, the plunger 16 is suctioned to the magnetized core section 15*b*. (At this point, the motor contact points remain open whereby the motor is not energized.) Therefore, the pinion gear 6 is pushed outward in the counter-motor direction integrally with the clutch 5, via the shift lever 7. Here, even when the end surface of the pinion gear 6 temporarily comes into contact with the end surface of the ring gear 24, because the ring gear 24 is rotating by inertia at a low speed, the pinion gear 6 is pressed outward by the reactive force stored in the drive spring 22 when the ring gear 24 rotates to a position allowing meshing with the pinion gear 6. Meshing is established between the pinion gear 6 and the ring gear 24.

Then, when the rotation of the engine completely stops, the starter relay 20 is opened, and energization of the solenoid coil 14 is stopped, a force returning the clutch 5 to the armature 3*a* side via the shift lever 7 is applied because the plunger 16 tries to return as a result of the reactive force of the return spring 12. On the other hand, because the clutch 5 is engaged with the outer circumference of the output shaft 4 by the helical spline 51, when a torsional angle of the helical spline 51 is set to be larger, the clutch 5 can be prevented from returned because movement resistance generated when the clutch 5 moves along the outer circumference of the outer shaft 4 along the helical spline 51 increases. As a result, the meshed state between the pinion gear 6 and the ring gear 24 can be maintained.

When the restart condition is established after the engine is stopped, the starter relay 20 is closed and the solenoid coil 14 is energized under the control of the ECU 2. At the same time, the switch coil 27 of the electromagnetic switch 10 is also energized. In the electromagnetic switch 10, when the movable core 28 is adhered to the magnetized core section 15*b* as a result of the switch coil 27 being energized, the motor contact points are closed as a result of the movable contact point 33 coming into contact with the pair of fixed contact points 32 and being urged by the contact point pressure spring 45. As a result, the battery 9 energizes the motor 3 and rotational force is generated. The rotational force is transmitted to the output shaft 4. Furthermore, the rotational force is transmitted from the output shaft 4 to the pinion gear 6 via the clutch 5. Because the pinion gear 6 is meshed with the ring gear 24 before the engine is stopped and the meshed state is maintained, the rotational force is transmitted from the pinion gear 6 to the ring gear 24. As a result, the engine is cranked.

(Effects According to the First Embodiment)

In the starter according to the first embodiment, pushing the pinion gear 6 towards the ring gear 24 side, and opening and closing the motor contact points can be performed by separate means (the electromagnetic solenoid 8 and the electromagnetic switch 10). Both means can be separately and independently controlled. Therefore, when idle-stop is performed, the pinion gear 6 can be meshed with the ring gear 24 during the inertial rotation of the ring gear 24 without use of the rotational force of the motor 3. In particular, because the solenoid coil 14 is energized when the rotation speed of the ring gear 24 is within a range that is a predetermined rotation speed (such as 300rpm) or less, the predetermined rotation speed being lower than the idling engine speed, the pinion gear 6 can be meshed with the ring gear 24 with certainty.

As described above, while the ring gear 24 is rotating by inertia, the pinion gear 6 can be meshed with the ring gear 24 simply by the solenoid coil 14 of the electromagnetic solenoid 8 being energized and the pinion gear 6 being pushed outward in the axial direction integrally with the clutch 5. Therefore, the rotational force of the motor 3 is not required to be used.

Even when energization of the solenoid coil 14 is subsequently stopped after the rotation of the ring gear 24 is stopped, the pinion gear 6 is not rotated because of the ring gear 24. Therefore, the meshed state between the pinion gear 6 and the ring gear 24 can be maintained without the pinion gear 6 separating from the ring gear 24. Therefore, when the restart condition is established after the engine is automatically stopped as a result of idle-stop, the engine can be quickly restarted by rotational force being generated in the motor 3 and the pinion gear 6 being driven, because the meshed state between the pinion gear 6 and the ring gear 24 is maintained.

In the starter 1 according to the first embodiment, the electromagnetic solenoid 8 and the electromagnetic switch 10 are integrally configured. The electromagnetic solenoid 8 and the electromagnetic switch 10 are disposed in series in the axial center direction of the electromagnetic solenoid 8. Therefore, dimensions are not increased in two directions radially outward of the motor 3. Therefore, the radial size can be minimized. Moreover, the total length in the axial direction of the electromagnetic solenoid 8 and the electromagnetic switch 10 does not exceed the overall length of the motor 3. Therefore, the size of the starter is not increased compared to the conventional starter in which a single electromagnetic switch serves to push the pinion gear 6 outward and to open and close the motor contact point. As a result, the ease of fixing the starter to the vehicle can be ensured in the same way.

(Second Embodiment)

The present invention according to a second embodiment will hereinafter be described with reference to FIG. 4 and FIG. 5.

Figure 4:
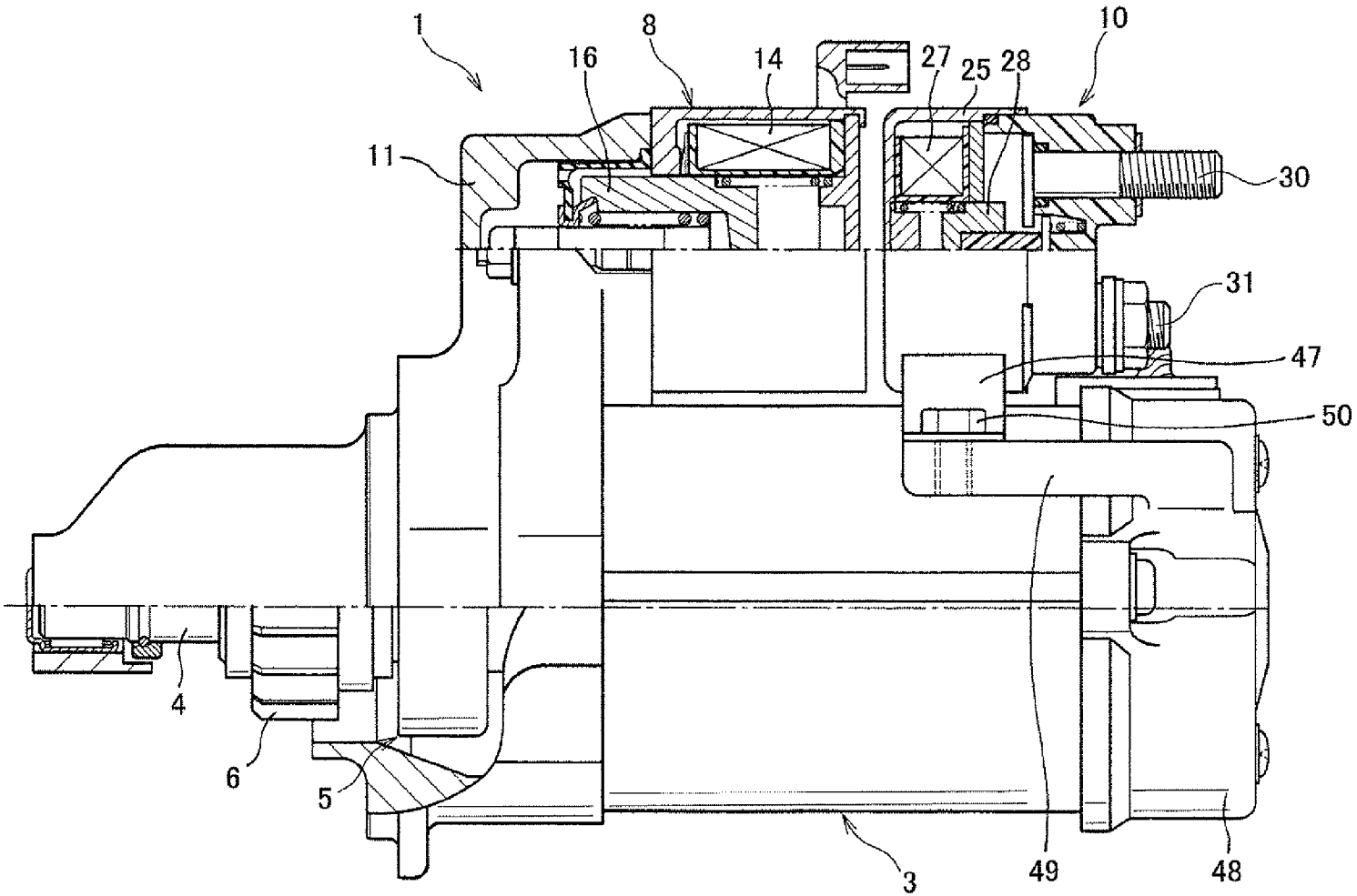
FIG. 4 is a side view of a starter (second embodiment)
Figure 5:
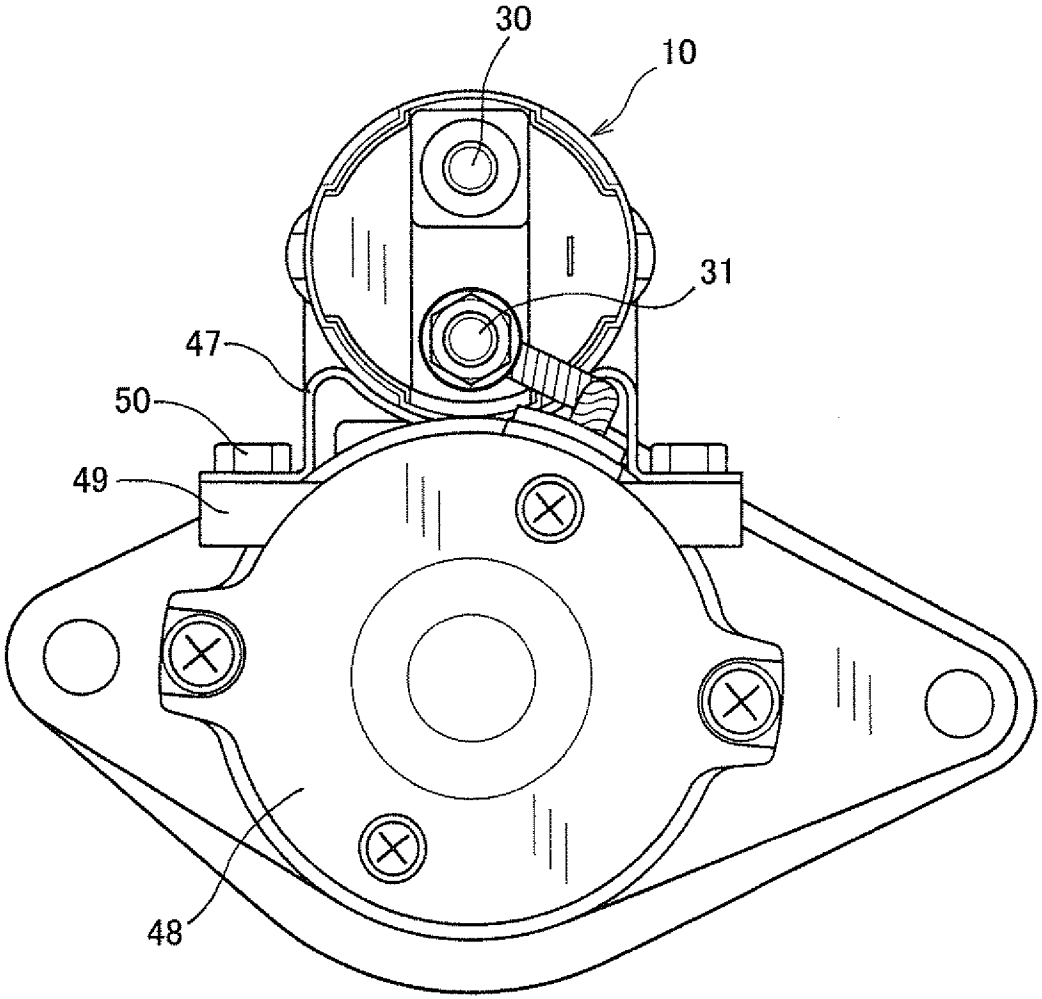
FIG. 5 is an axial-direction rear view of a starter viewed from a motor side.

In an example according to the second embodiment, as shown in FIG. 4, the electromagnetic solenoid 8 and the electromagnetic switch 10 are configured separately and individually. In addition, the electromagnetic solenoid 8 and the electromagnetic switch 10 are disposed such as to be adjacent in the axial direction (the axial center direction of the electromagnetic solenoid 8). In the starter 1 shown in FIG. 4, a slight gap is formed between the electromagnetic solenoid 8 and the electromagnetic switch 10. However, the electromagnetic solenoid 8 and the electromagnetic switch 10 can be disposed such as to be in contact with each another. The electromagnetic solenoid 8 is fixed to the starter housing 11 in parallel with the motor 3.

The electromagnetic switch 10 is disposed such that the axial center direction (operating direction of the movable core 28) is the same direction as the axial center direction of the electromagnetic solenoid 8. As shown in FIG. 5, the electromagnetic switch 10 is fixed to a base 49 provided on an end frame 48 of the motor 3 by an attaching member 47 fixed to the switch case 25. The attaching member 47 is, for example, fixed to the switch case 25 by spot welding. On the other hand, the base 49 can be provided integrally with the end frame 48 by, for example, die-casting. As shown in FIG. 4, the base 49 is formed extending from the end frame 48 in the axial direction towards a yoke side of the motor 3. The attaching member 47 is fixed to the base 49 by a bolt 50 being tightened thereon.

In the above-described configuration as well, in a manner similar to that according to the first embodiment, when idle-stop is performed, the pinion gear 6 can be meshed with the ring gear 24 during the inertial rotation of the ring gear 24 without use of the rotational force of the motor 3. The meshed state can be maintained. As a result, the engine can be quickly restarted when a restart condition is established. The frequency of use of the starter 1 significantly increases in an idle-stop vehicle. Therefore, wearing of the motor contact points may progress, requiring replacement. In this regard, because the electromagnetic solenoid 8 and the electromagnetic switch 10 are configured separately and individually in the starter 1 according to the second embodiment, only the electromagnetic switch 10 is required to be replaced when the motor contact points wear out and a replacement is required. The running cost can be reduced because the electromagnetic solenoid 8 is not required to be replaced in addition to the electromagnetic switch 10. Moreover, many components used in a conventional electromagnetic switch (such as that described in Japanese Patent Laid-open Publication No. 2008-163818) can be used in the electromagnetic solenoid 8. A general-purpose electromagnetic relay can be used as the electromagnetic switch 10. Therefore, cost can be reduced.

What is claimed is:

1. A starter mounted on a vehicle having an idle-stop apparatus that automatically controls stop and restart of an engine, the starter for starting the engine comprising:

a motor that generates a rotational force by being energized;

an output shaft that rotates by receiving the rotational force from the motor;

a one-way clutch that is engaged with an outer circumference of the output shaft by a helical spline;

a pinion gear provided such as to be movable in an axial direction along the outer circumference of the output shaft, integrally with the one-way clutch, the pinion gear being capable of meshing with a ring gear of the engine;

an electromagnetic solenoid that generates force for pushing the pinion gear integrally with the one-way clutch outward in the axial direction towards a ring gear side of the engine;

an electromagnetic switch that opens and closes a motor contact point provided on an energizing circuit of the motor; and controlling means for controlling an operation of the starter wherein the controlling means is configured to control the electromagnetic solenoid and the electromagnetic switch independently, such that the controlling means energizes the electromagnetic solenoid during inertial rotation of the ring gear until the ring gear stops rotating when the engine is automatically stopped, and stops energizing the electromagnetic solenoid after the engine stops rotating, wherein the electromagnetic switch is the only electromagnetic switch of the starter.

2. The starter according to claim 1, further comprising:

rotation speed detecting means for detecting a rotation speed of the ring gear, wherein the controlling means is configured to energize the electromagnetic solenoid when the rotation speed of the ring gear detected by the rotation speed detecting means drops to a predetermined rotation speed or less, the predetermined rotation speed being lower than an idling engine speed.

3. The starter according to claim 2, wherein the rotation speed detecting means is a crank angle sensor.

4. The starter according to claim 1, wherein the controlling means is an idle-stop electronic control unit involved with control of the idle-stop apparatus.

5. The starter according to claim 2, wherein the controlling means is an idle-stop electronic control unit involved with control of the idle-stop apparatus.

6. The starter according to claim 3, wherein the controlling means is an idle-stop electronic control unit involved with control of the idle-stop apparatus.

7. The starter according to claim 1, wherein the starter is configured such that the electromagnetic solenoid and the electromagnetic switch are integrated and are disposed in series in an axial center direction of the electromagnetic solenoid.

8. The starter according to claim 2, wherein the starter is configured such that the electromagnetic solenoid and the electromagnetic switch are integrated and are disposed in series in an axial center direction of the electromagnetic solenoid.

9. The starter according to claim 3, wherein the starter is configured such that the electromagnetic solenoid and the electromagnetic switch are integrated and are disposed in series in an axial center direction of the electromagnetic solenoid.

10. The starter according to claim 4, wherein the starter is configured such that the electromagnetic solenoid and the electromagnetic switch are integrated and are disposed in series in an axial center direction of the electromagnetic solenoid.

11. The starter according to claim 1, wherein the starter is configured such that the electromagnetic solenoid and the electromagnetic switch are separate, individual components and are adjacent to or in contact with each other in an axial center direction of the electromagnetic solenoid.

12. The starter according to claim 2, wherein the starter is configured such that the electromagnetic solenoid and the electromagnetic switch are separate, individual components and are adjacent to or in contact with each other in an axial center direction of the electromagnetic solenoid.

13. The starter according to claim 3, wherein the starter is configured such that the electromagnetic solenoid and the electromagnetic switch are separate, individual components and are adjacent to or in contact with each other in an axial center direction of the electromagnetic solenoid.

14. The starter according to claim 4, wherein the starter is configured such that the electromagnetic solenoid and the electromagnetic switch are separate, individual components and are adjacent to or in contact with each other in an axial center direction of the electromagnetic solenoid.

* * * * *